US005092010A

United States Patent [19]

Wong

[11] Patent Number: 5,092,010

[45] Date of Patent: Mar. 3, 1992

[54] BEDCLOTHES

[76] Inventor: Wai S. Wong, 1506 31st Ave., San Francisco, Calif. 94122

[21] Appl. No.: 658,114

[22] Filed: Feb. 20, 1991

[51] Int. Cl.[5] ..... A47G 9/00

[52] U.S. Cl. ..... 5/496; 5/493; 5/498; 5/502

[58] Field of Search ..... 5/485, 486, 493, 494, 5/496–498, 499, 500

[56] References Cited

U.S. PATENT DOCUMENTS

| | | | |
|---|---|---|---|
| 1,732,663 | 10/1929 | Schimmel | 5/449 |
| 2,729,831 | 1/1956 | Fuld et al. . | |
| 2,789,292 | 4/1957 | Budinquest | 5/496 X |
| 2,804,632 | 9/1957 | Ford | 5/496 |
| 2,870,463 | 1/1959 | Hoppe . | |
| 2,907,055 | 10/1959 | Berman | 5/496 |
| 3,083,378 | 4/1963 | Pursell | 5/334 |
| 3,570,026 | 3/1971 | Allison | 5/486 |
| 3,999,233 | 12/1976 | Morris | 5/493 |
| 4,040,133 | 8/1977 | Gilreath . | |
| 4,316,299 | 2/1982 | Friedman | 5/485 |
| 4,546,508 | 10/1985 | Ison | 5/494 |
| 4,587,683 | 5/1986 | Gardiner | 5/493 |
| 5,003,655 | 4/1991 | Kafai | 5/497 X |

FOREIGN PATENT DOCUMENTS 2079596 1/1982 United Kingdom .

*Primary Examiner*—Michael F. Trettel

*Attorney, Agent, or Firm*—Jacques M. Dulin; Thomas C. Feix

[57] ABSTRACT

Bedclothes with fasteners to hold them in place on a bed and maintain a neat appearance of the bed. The bedclothes comprises casings which slip over the foot and head of the bed. A top surface of the bedclothes attached to the casing with a fastener such as Velcro. Optionally the casings and top surface of the bedclothes may be formed as an integral piece. The bed clothes are suitable for use as sheets, bedspreads and dust ruffles. The bedclothes with the separate casings may be removed for washing without removing the casings.

15 Claims, 3 Drawing Sheets

BEDCLOTHES

BACKGROUND OF THE INVENTION

The present invention relates to bedclothes, in particular bedsheets, used to make up a bed. Typical bedclothes consist of a single piece of fabric held in place by tucking portions of the fabric under the mattress. Bedclothes held in place in this way often pull loose when the user tries to pull the bedclothes smooth. This can make bed-making difficult and time-consuming. These bedclothes can also come loose while the bed is being used. The loose bedclothes cause the occupant of the bed to become uncovered or tangled in the bedclothes and make sleep uncomfortable or impossible.

One attempt to deal with these problems consists of bedclothes fitted snugly around the horizontal sides of the mattress. This solution, however, is only practical for bottom sheets where the occupant does not get under the bedclothes. Moreover, a fitted sheet is held flat on the mattress by means of tension provided by an elastic band which runs along the outside edge of the sheet. Placing the fitted sheet on the mattress requires that elastic be pulled taut so that the sheet corners may be placed over the mattress corners. The construction of the fitted sheet can, therefore, make placement of the sheet on the mattress difficult. Furthermore, this kind of fitted sheet is easily dislodged during use since kicking a single corner of the sheet off the mattress relieves the tension that holds the sheet in place. The sheet is, therefore, difficult to maintain in a smooth, neat appearance. In addition, the elastic band of the fitted sheet makes the sheet difficult to fold neatly for storage in a closet or drawer.

Another solution, described U.S. Pat. No. 2,729,831, to Fuld, uses a casing fitted over a mattress end to which a blanket is attached, using visible ties. The casing permanently attaches to the blanket and requires fitting the casing/blanket combination over the mattress each time the blanket is washed. The Fuld patent also does not suggest or disclose a bedspread, which is held especially firmly in place at the foot and head of the bed in order to ensure that the unused bed looks neat.

SUMMARY OF THE INVENTION

The present invention provides a system of bedclothes that simplifies the bed-making process and aids in keeping the 10 bedclothes in place while the bed is in use. The present invention thus facilitates maintenance of an attractive and neat looking bed.

According to one embodiment of the present invention, a bed covering, which may be a bedspread, is held in place by fasteners connecting it to casings which fit over the ends of a mattress. A person making the bed need only pull the bed covering smooth and attach it to the casings to get a neat look that persists even through minor disturbances, such as someone sitting on the bed. In order to use the bed one need only detach the covering from the casing on the top end of the mattress and the covering remains held in place by the fastener on the lower casing. To remake the bed the user pulls the covering smooth again and reattaches the covering to the upper casing.

According to another embodiment of the present invention, a bottom sheet is constructed in such a way as to form its own casings to fit over the ends of a mattress. At least one of the seams of the sheet is not permanently closed, but rather includes a fastener to close the seam tight after fitting the sheet over the mattress. Because the sheet of the present invention wraps around a larger portion of the mattress than a conventional fitted sheet and is fastened once in place, the sheet of the present invention does not come loose.

According to yet another embodiment of the present invention, a bedspread includes a fastener used to attach a piece of fabric to the central portion of the bedspread. This bedspread construction permits the removal of this portion of the bedspread for cleaning and, in addition, allows for the exchange of different decorative images for the central portion of the bedspread. The bedspread appearance is thus easily adapted to changes in color scheme or decor without incurring the expense of an additional bedspread.

According to yet another embodiment of the present invention a dust ruffle is attached to a bed by means of a pair of casings similar to those described for the bed covering. The casings fit over the box spring rather than the mattress. The dust ruffle is attached to the casings by means of fasteners along its upper edge.

A further understanding of the nature and advantages of the invention may be realized by reference to the remaining portions of the specification and the drawings.

DESCRIPTION OF THE PREFERRED EMBODIMENT

Figure 1:
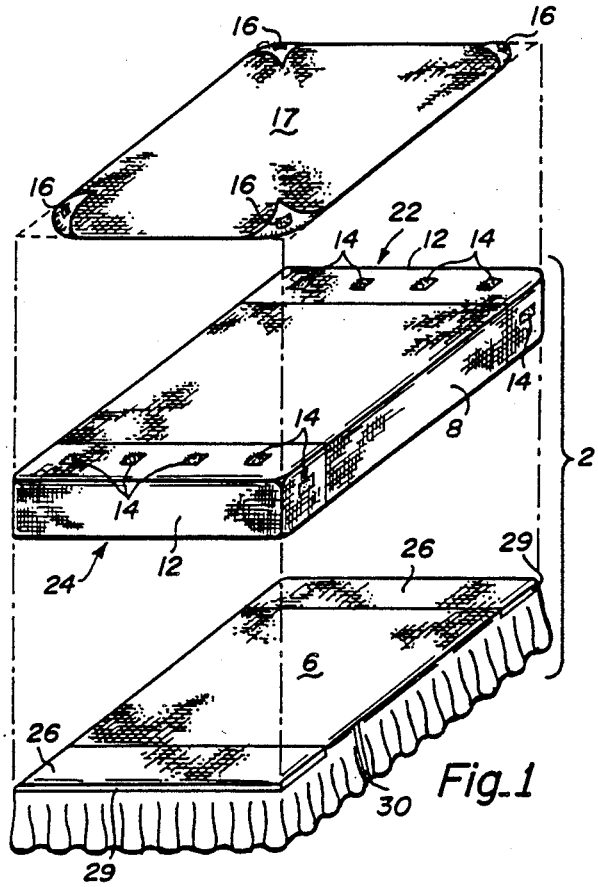
FIG. 1 is an exploded view of a bed incorporating embodiments of the present invention.
Figure 2:
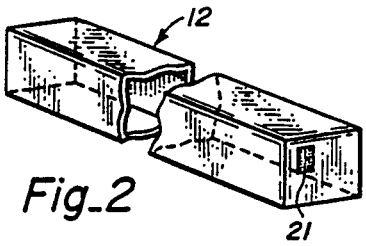
FIG. 2 is a perspective view of a mattress casing according to an embodiment of the present invention.

FIG. 1 is an exploded view of a bed 2 made up according to an embodiment of the present invention. Bed 2 comprises a box spring mattress 6 over which is located a mattress 8. Over each end of mattress 8 is fitted a casing 12. Casing 12 covers the end of mattress 8 and extends a certain distance along the length of mattress 8 to cover portions of the top, bottom and peripheral edges of mattress 8 to fit snugly over mattress 8. FIG. 2 is a perspective drawing of a casing 12 removed from a mattress with a portion of casing 12 cut away to better show its shape. Casing 12 has a fastener 21 attached to it.

Casings 12 of FIG. 1 have fasteners 14. In a preferred embodiment of the invention, fasteners 14, or 21, are made of Velcro TM brand hook and loop fasteners which mate with a complementary fastener 16 located on top cover 17. For typical applications, a total of 4–12 fasteners is suitable. The corners of bedclothes 17 are folded back in the figure so as to reveal complementary fasteners 16. In a preferred embodiment, top cover 17 and casings 12 are made from a flexible material such as fabric.

Box spring 6 as seen in FIG. 1 is also fitted with a pair of casings 26 to which a dust ruffle 28 is attached. Dust ruffle 28 may be attached using hook and loop type fasteners as described above or may be permanently sewn to casings 26. In FIG. 1, dust ruffle 28 is attached to casings 26 with zippers 29. Dust ruffle 28 is preferably formed of a single piece of material. However, a closeable fastener 30, which may also be a hook and loop type fastener, can be used to join the two ends of the material together to facilitate placement of ruffle 28 around the bed perimeter.

While the embodiment described herewith uses Velcro TM brand fasteners, it will be apparent to those of skill in the art that other fasteners such as snaps, buttons, or zippers may be used. Note that these fasteners may be constructed so as not to be visible when the bedclothes are in place, thereby enhancing the neat appearance of the present invention.

If top cover 17 comprises a bottom sheet, then fasteners 16 and 14 are mated to firmly hold the sheet in place. If sheet 17 comprises a top sheet or blanket, then fasteners 14 and 16 remain secured at a foot region 22 of bed 2 and can be unfastened at a head region 24 of the bed. To make up the bed, fasteners 16 and 14 can be mated to secure bedclothes 17 in the made-up configuration. The structure of the present invention in which bedcoverings attach to casings fitted firmly in place over a mattress allows easy removal of the bedcovering without sacrificing the ability to firmly hold the bedcovering in place during daily use.

Figure 3:
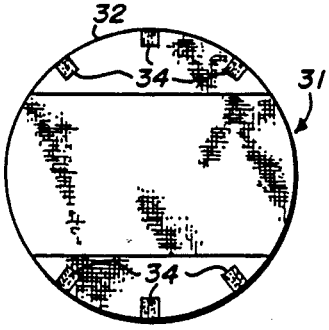
FIG. 3 is an overhead view of an embodiment of a mattress casing of the present invention fitted over a circular mattress.
Figure 3A:
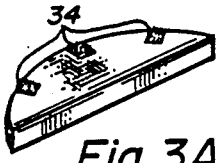
FIG. 3A is a perspective view of a casing construction for fitting over a circular mattress according to an embodiment of the present invention.

FIG. 3 is an overhead view of a circular mattress 31 fitted with an embodiment of casings 32 according to the present invention with a set of fasteners 34 that can be used to attach a bed covering to the bed. FIG. 3A is a perspective view of a casing 32 showing its construction. These figures illustrate the adaptability of the present invention to fit unconventional bed sizes and shapes by conforming the casings to the bed's shape such that the casing covers a sufficient portion of the top, bottom and peripheral/circumferential edge portions of the mattress ends to be securely fitted to the mattress.

Figure 4:
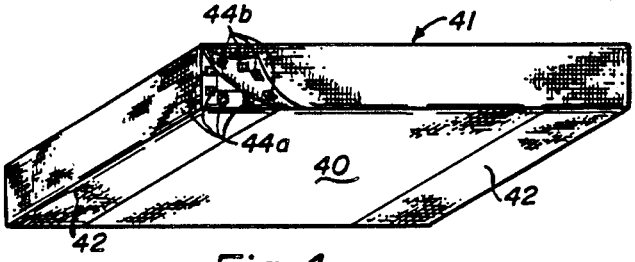
FIG. 4 is a view from the underside of a mattress fitted with a bottom sheet according to an embodiment of the present invention.

FIG. 4 is a perspective view from the underside of a bed or mattress 40 made up with a bed cloth 41 having an integral casing according to an embodiment of the present invention. Bed cloth 41 covers the top, peripheral edges and portions of the bottom surfaces of mattress 40 forming a pair of mattress casings 42, which enclose the ends of bed 40 to hold bed cloth 41 in place. One of these casings can be opened and closed to ease fitting the bed cloth over the bed. A fastener **44*a*, which may be a hook and loop fastener, can be joined to a fastener 44*b* to close the casing. While fasteners 44*a* and 44*b* are fastened, bed cloth 41 cannot easily be displaced from bed 40**.

Figure 5:
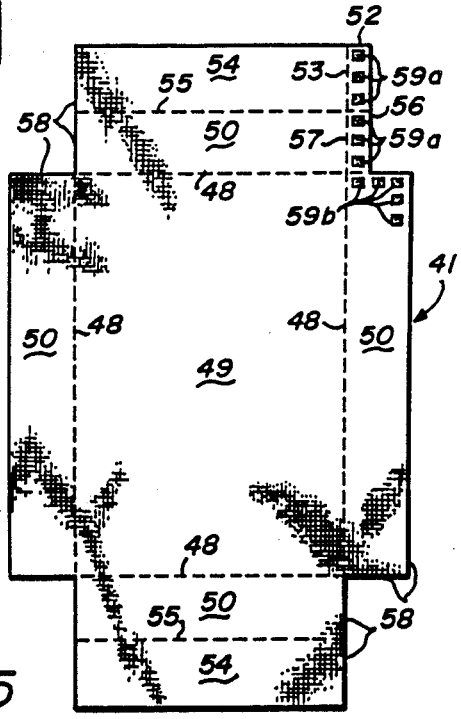
FIG. 5 is a view of a piece of fabric from which a bedsheet can be formed according to an embodiment of the present invention.

FIG. 5 shows an embodiment of how a bed cloth 41 such as that shown in FIG. 4 could be made from a flat piece of fabric or other flexible material. Solid lines represent the fabric edges and dotted lines represent lines along which the fabric is folded. The fabric is first folded down along a set of lines 48 ninety degrees. The region 49 bounded by lines 48 becomes the top panel of bed clothes 41. Regions 50 form the peripheral edge panels of bedclothes 41. Then a panel 52 is folded along a line 53 to form a 90° angle with panel 54. Next, a pair of panels 54 of the fabric are folded 90° toward the center of the bed cloth along a pair of lines 55. Panels 54 ultimately form the bottom panels of bed clothes 41. Panel 56 is then folded toward the center of the sheet along a line 57 and the portion of panels 52 and 56 that overlap are sewn together. Then, the fabric is sewn together along a set of lines 58 where edges of the fabric adjoin one another. A fastener **59*a*, such as pieces of a hook and loop fastener, is attached to panels 52 and 56 and a complementary fastener 59*b* is attached to the edge surface of bed cloth 41 adjacent to panels 52 and 56. The folded and sewn material of FIG. 5 forms the completed bed cloth 41 shown in FIG. 4**.

While the above description describes one possible method of making a bedcloth with one closeable casing many minor variations on this invention would be apparent to those of skill in the art. For example, while the embodiment described uses hook and loop fasteners, other fasteners such as snaps, buttons, and zippers, could also be used. Alternatively, both casings could be closed by fasteners, or both sides of the same casing could be closed by using more than one set of sealable flaps. This construction further facilitates the process of putting a sheet on a bed. Furthermore, several methods of forming bedcloth 41 other than from a single piece of material can be employed. For example, casings 42 may each be formed of a separate piece of material then sewn to a third piece of material which forms the side and top regions of bedcloth 41

Figure 6:
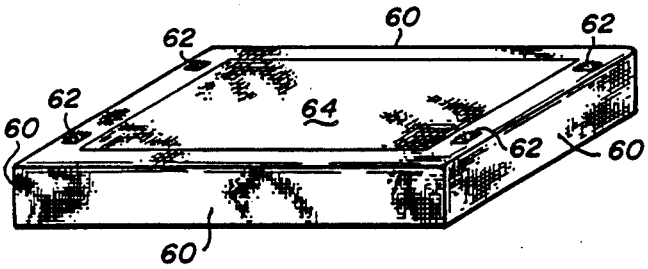
FIG. 6 is a perspective view of a bed made up with a bedspread equipped to connect to a decorative piece of fabric according to an embodiment of the present invention.
Figure 7:
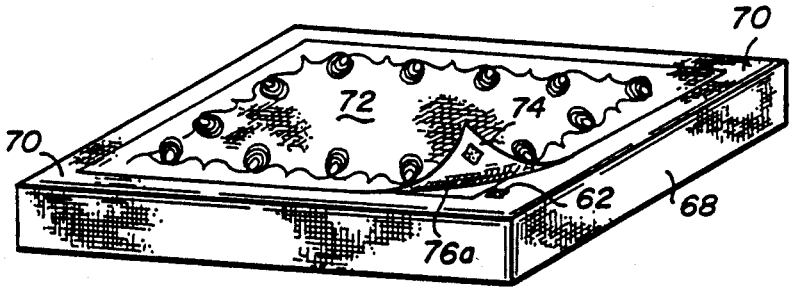
FIG. 7 is a perspective view of a bed made up with a bedspread having a decorative piece of fabric attached over the central portion of the bedspread according to an embodiment of the present invention.

FIG. 6 shows a bedspread 60 constructed according to an embodiment of the present invention. Bedspread 60 has a hook and loop fastener 62 to attach a decorative piece of fabric to cover the central portion 64 of bedspread 60. FIG. 7 shows a bedspread 60 with a decorative piece 72 attached. A corner 74 of the decorative piece is lifted to reveal a fastener 76 on the decorative portion which mates with complementary fastener 62 on the bedspread. Fasteners 76 and 62 serve to hold decorative portion 72 tightly in place, but allow easy removal for separate washing of this portion of the bedspread. Variations in the described embodiment are possible, such as different shapes of removable portions or the use of various fasteners known to those of skill in the art in place of a hook and loop fastener.

Figure 8:
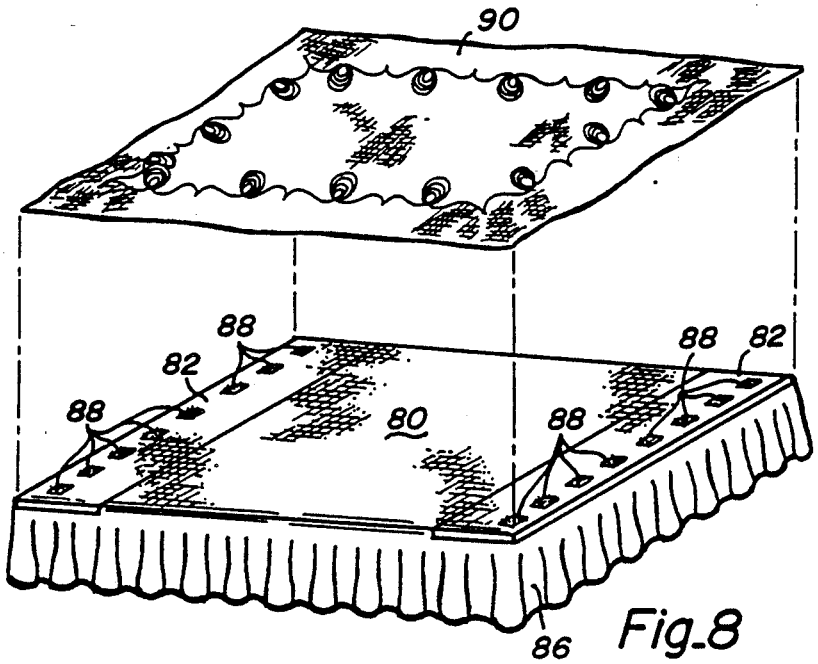
FIG. 8 is a perspective view of a bedspread having casings and a removable decorative portion according to an embodiment of invention.

FIG. 8 shows an alternative bedspread 80 formed of a pair of casings 82 and having a dust ruffle 86 attached. Dust ruffle 86 may be attached as described in FIG. 1. A set of fasteners 88 mate with a complimentary set of fasteners (not shown) located on decorative bedspread portion 90 and secure portion 90 to the bedspread. Decorative portion 90 can be easily removed for washing or to accommodate a new decor. Bedspread 80 can thus secure itself and any decorative features attached to it in a neat and tidy position.

Figure 9:
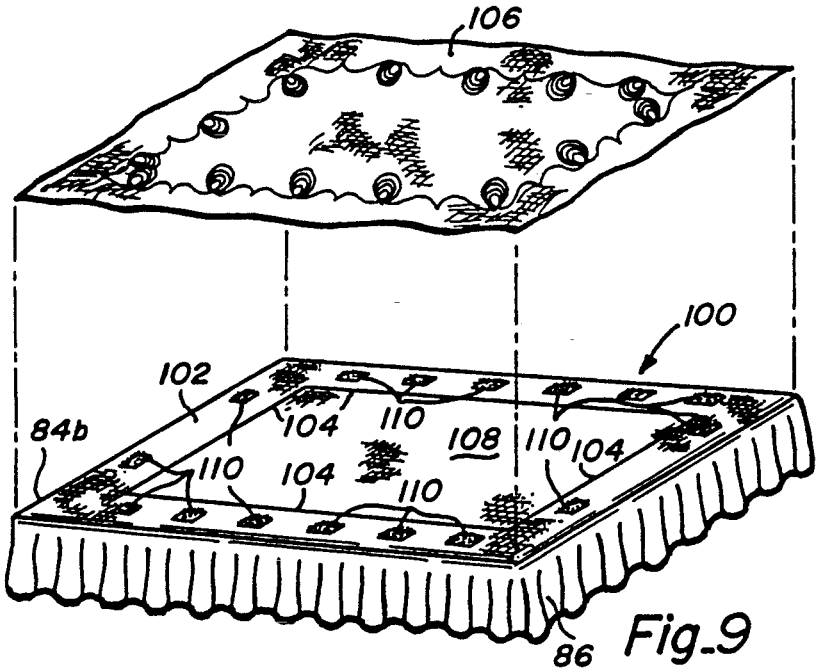
FIG. 9 is a perspective view of a bedspread having a peripheral casing formed of a frame bordering a top edge perimeter of the bedspread according to an embodiment of the present invention.

FIG. 9 shows yet another alternative bedspread structure. In this structure, the bedspread 100 is formed of a piece of fabric or other flexible material which drapes over the bed as shown, the bedspread has a free hanging lower edge. A frame, or peripheral casing, 102 is stitched around on the bedspread fabric. Edges 104 are not stitched to the bedspread fabric and are open. Blankets and other bedclothes may be tucked into frame 102. A decorative piece 106 may then be placed over region 108 of bedspread 100. Decorative piece 106 may be draped over regions 108, or secured to frame 102 with fasteners 110, or tucked in frame 102.

Figure 10:
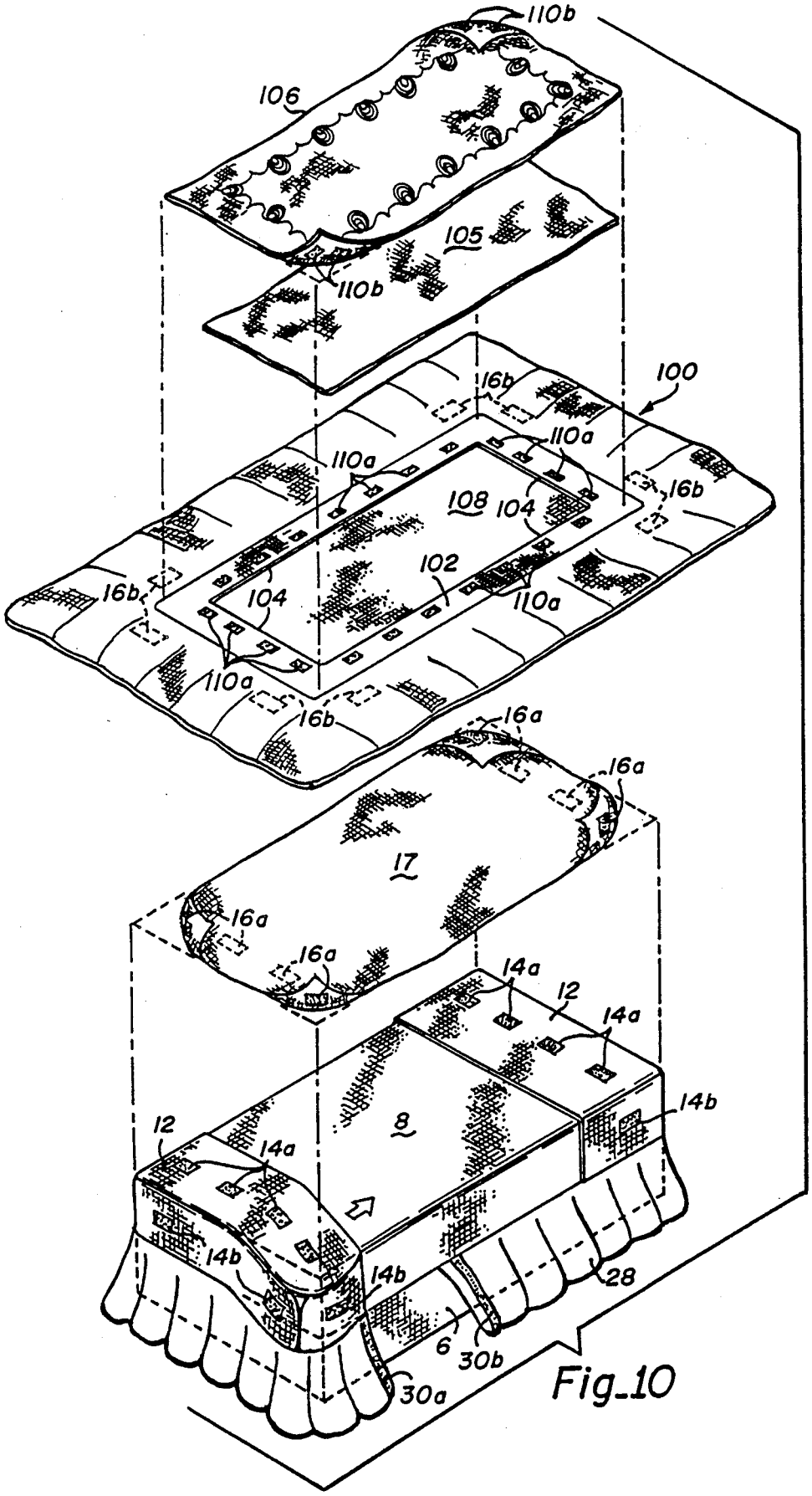
FIG. 10 is an exploded perspective view of the invention showing how the various bedclothes may be fitted onto a bed.

In accordance with the method aspects of the invention, FIG. 10 shows how the bedclothes are fitted onto the mattress 8 and boxspring 6. As is explained in the description with the embodiment shown in FIG. 1, casings 12 are first fitted over the head and foot end portions of a mattress 8. A dust ruffle 28 is then attached to the side edge portion of casings 12 and includes overlapping end portions which may be connected onto one another by means of hook and loop type fasteners 30*a*, 30*b*. While only the mattress 8 is shown as being fitted with casings 12, it is understood that separate casings may also be provided to the box spring and the dust ruffle may alternately be attached to the boxspring casings.

Next the cover or bedsheet 17 is placed over the mattress 8 having the fastener members 16*a* of the bedsheet 17 engaging cooperating fasteners 14*a* on the top surface of casings 12. Bedsheet 17 in this embodiment serves as the bottom sheet of a fully made up bed. A bedspread 100 is then draped over the mattress 8 and is secured thereto by means of fasteners 16*b* which cooperate with corresponding fasteners 14*b* disposed on the sidewalls of casings 12. As is discussed above with reference to FIG. 9, a blanket or comforter 105 may be placed within the central region 108 of the bedspread 100 such that the perimeter edges of the added blanket are tucked under edges 104 of the bedsheet 100. A top decorative sheet 106 may then be placed over the open region 108 and secured thereto having fastener members 110*b* engaging cooperating fastening members 110*a* disposed along the top surface of the bedspread.

An embodiment of the present invention has now been described. Variations and modifications will be readily apparent to those of skill in the art. For example, the casings could be sized to fit over both the box spring and mattress portions of the bed. For this reason, the above description should not be taken as limiting the scope of the invention which is defined by the appended claims.

What is claimed is:

1. A bedclothes system for a bed having at least one mattress comprising:

a first casing having top, bottom and peripheral side panels to conformingly fit over a first given end portion of a top, a bottom, and edge portions of said mattress;

a second separate casing, spaced a given distance from said first casing, having top, bottom and peripheral side panels to conformingly fit over a second given end portion of said top, said bottom, and said edge portions of said mattress;

a first cover piece, having a first and a second end, for covering at least a top area of said mattress;

means for removably fastening said first end of said cover piece to the top panel of said first casing; and means for removably fastening said second end of said cover piece to the top panel of said second casing.

2. The bedclothes system of claim 1 further comprising:

a dust ruffle spanning at least a length between said first and second casings and secured to said peripheral side panels of said first and second casings; and said dust ruffle having at least one pair of overlapping ends disposed medial of said first and second casings wherein said overlapping ends include means for detachable fastening with respect to each other to permit convenient mattress fitting and removal of said casings and said dust ruffle as a unit.

3. The bedclothes system of claim 2 wherein said dust ruffle is removably secured to said first and second casings.

4. The bedclothes system of claim 3 wherein said removably fastening means is selected from a group of fasteners consisting of hook and loop type fasteners, snaps, buttons, and zippers.

5. The bedclothes system of claim 2 which further comprises:

a second cover piece for draping over said first cover piece, said second cover piece being removably securable to each of said casings independent of said first cover piece fastening means, said second cover piece includes:

a frame piece disposed to lay over a center portion of said second cover piece and having an outer perimeter edge secured thereto and an unsecured inner perimeter edge spaced a sufficient distance from said outer perimeter edge to permit outer perimeter edge portions of a provided blanket or comforter to be tucked thereunder; and a center decorative portion removably secured to said second cover piece and having a size dimension sufficient to cover said frame piece inner perimeter edge.

6. The bedclothes system of claim 5 wherein said center decorative portion and said second cover piece further comprise a hook and loop type fastener system for securing said center decorative portion to said second cover piece.

7. The bedclothes system of claim 1 wherein said cover piece and said mattress casings are sized so as to fit a rectangular bed.

8. A bedclothes system for a bed having at least one mattress comprising:

a first casing having top, bottom and peripheral side panels to conformingly over a first given end portion of a top, a bottom, and edge portions of said mattress;

a second separate casing having top, bottom and peripheral side panels, spaced a given distance from said first casing , to conformingly fit over a second given end portion of said top, said bottom, and said edge portions of said mattress;

a dust ruffle spanning at least a distance between said first and second casings; and means for removably securing said dust ruffle to said side peripheral panels of said first and second casings.

9. Bedclothes for a bed having a top portion, a bottom portion and peripheral edges, comprising:

a top panel to cover said top portion of said bed;

a peripheral side panel to cover said peripheral end and side edges of said bed and located adjacent said top panel, said peripheral side panel including a single strip of material having overlapping ends disposed adjacent a bed corner when said bedclothes are fitted over said bed;

a first bottom panel, adjacent a first given end portion of said peripheral side panel, and covering a given area of said bed bottom portion, to form a first casing for fitting over a first end of said bed;

a second bottom panel, spaced a given distance from said first bottom panel and adjacent a second given end portion of said peripheral side panel, and covering a given area of said bottom portion to form a second casing, and means for adjustable fastening of said overlapping ends of said peripheral side panel to each other and to an adjacent side edge portion of one of said bottom portions to permit adjustable fitting of said bedclothes on said bed.

10. The bedclothes of claim 9 wherein said means for adjustable fastening includes a hook and loop type fastener.

11. A bedspread for a bed comprising:

a first piece of flexible material for draping over said bed, said first piece having a free hanging lower edge;

a second frame piece of flexible material, said second frame piece being smaller than said first piece and having an outer perimeter edge secured to said first piece of flexible material such that when said first piece of flexible material is draped over said bed, said outer perimeter edge of said second frame piece is disposed coordinate with a top perimeter edge of said bed;

said second frame piece of material having an unsecured inner perimeter edge defining a pocket type opening for receiving additional bedclothes;

a top decorative piece having a dimension sufficient to cover said pocket opening of said second frame piece; and means for removably fastening said top decorative piece to said second frame piece.

12. A method for making a bed having peripheral edges including head and foot regions comprising the steps of:

placing a first casing over said foot region of said bed;

placing a second separate casing over said head region of said bed;

placing a top piece over a top surface of said bed; and removably securing said top piece to said first and second casings.

13. The method for making a bed of claim 12 further comprising the steps of:

placing a dust ruffle having overlapping ends around said peripheral edges;

securing said dust ruffle to said first and second casings with said overlapping ends of said dust ruffle disposed medial of said first and second casings; and removably securing said overlapping ends together.

14. The method for making a bed of claim 13 further comprising the steps of:

removably securing a decorative portion to said top piece.

15. A method for making a bed having peripheral edges including a head and a foot regions comprising the steps of:

placing a first casing over said foot region of said bed;

placing a second separate casing over said head region of said bed;

placing a dust ruffle around said peripheral edges; and removably securing said dust ruffle to said first and second casings.

* * * * *